United States Patent [19]

Butler

[11] 4,115,037

[45] Sep. 19, 1978

[54] OPPOSED PISTON INTERNAL COMBUSTION ENGINE-DRIVEN PUMP

[75] Inventor: Stanley Milton Butler, Hassocks, England

[73] Assignee: Direct Power Limited, London, England

[21] Appl. No.: 643,857

[22] Filed: Dec. 23, 1975

[30] Foreign Application Priority Data

Jan. 3, 1975 [GB] United Kingdom ..... 193/75

[51] Int. Cl.[2] ..... F04B 17/00; F04B 35/00; F02B 25/08; F02B 75/28

[52] U.S. Cl. ..... 417/341; 417/364; 417/380; 123/51 B; 123/71 V; 123/74 AC

[58] Field of Search ..... 417/380, 364, 341; 123/46 R, 46 B, 71 V, 73 AD, 51 B, 192 B, 74 AC, 74 AE; 92/86; 138/237 R, 238

[56] References Cited

U.S. PATENT DOCUMENTS

| | | | |
|---|---|---|---|
| Re. 17,457 | 10/1929 | Davey et al. | 417/364 |
| 655,475 | 8/1900 | Calloch | 123/192 B |
| 1,171,854 | 2/1916 | Kramer | 123/192 B |
| 2,203,648 | 6/1940 | Dons | 123/51 BB |
| 2,241,957 | 5/1941 | Pescara | 417/364 |
| 2,273,202 | 2/1942 | Jackson | 123/73 AD |
| 3,003,469 | 10/1961 | Kelsey | 92/86 |
| 3,112,060 | 11/1963 | Ollier et al. | 417/341 |
| 3,234,395 | 2/1966 | Colgate | 123/46 E |
| 3,369,733 | 2/1968 | Campbell | 417/341 |
| 3,414,187 | 12/1968 | McMullin et al. | 417/364 |

FOREIGN PATENT DOCUMENTS

| | | | |
|---|---|---|---|
| 878,302 | 1/1943 | France | 92/86 |
| 1,372,777 | 11/1974 | United Kingdom | 417/415 |

*Primary Examiner*—Carlton R. Croyle
*Assistant Examiner*—Thomas I. Ross
*Attorney, Agent, or Firm*—Lowe, King, Price & Markva

[57] ABSTRACT

An engine driven reciprocating air compressor. The engine is operated in a through scavenge two-stroke mode. The engine has opposed pistons reciprocating in opposition in a cylinder, the pistons being rigidly connected to respective compressor pistons working in compressor cylinders. A crankshaft rotates about an axis perpendicular to and intersecting the engine cylinder axis. The piston pairs are directly coupled to the crankshaft by connecting rods. The crankshaft synchronizes the piston pairs, defines their strokes, and provides rotary motion for auxiliary devices. The connecting rods and crankshaft are lightweight and do not transmit full engine power. The piston pairs are provided with inward return energy from a flywheel on the crankshaft and air trapped in compressor cylinder clearance volumes. The inward faces of the compressor pistons may be used to compress fuel/air mixture to the scavenge pressure. Further vented cylinders and pistons may be used between the engine and compressor pistons to fully isolate the fuel/air mixture from the air being compressed.

19 Claims, 3 Drawing Figures

OPPOSED PISTON INTERNAL COMBUSTION ENGINE-DRIVEN PUMP

BACKGROUND OF THE INVENTION

This invention relates to power units including an opposed piston internal combustion engine. It has application for example in engine driven reciprocating fluid compressors.

Most prior engine driven reciprocating air compressors comprise an engine coupled to an air compressor in which the power from the engine cylinder is transmitted to the compressor cylinder by means of the pistons, connecting rods, and crank shaft of the engine, the coupling between the engine and the compressor, and the crank shaft, connecting rods and pistons of the compressor. All these parts transmit the full power output of the engine and, with their associated bearings and running gear represent considerable weight and space.

Free-piston engine compressors are also known in which an opposed pair of engine pistons are directly and rigidly connected to respective compressor pistons and in which the stroke is variable. These, however, require special control devices which add to weight and complexity, in order, for example, to prevent excessive stroke when delivering against low pressure or excessive compression pressure in the engine cylinder when delivering against high pressure. In addition there is no carry-over of energy from one cycle to the next and, in consequence, they can be difficult to start and will stop instantly if combustion in the engine cylinder is not correct. Further disadvantages of the free-piston engine compressors are that the designer has inadequate control over speed since this is determined by the mass of the moving parts and the resultant of the pressures acting on them; and the absence of rotary motion which makes it difficult to drive cooling fans, water and oil pumps, and which necessitates unconventional and often heavy starting devices.

SUMMARY OF THE INVENTION

According to the present invention in one aspect, a power unit comprises an internal combustion engine which includes first and second opposed engine pistons arranged to reciprocate in opposition in a common engine cylinder. First and second engine power utilization devices have substantially similar power absorbing characteristics with respect to one another and each has a driven member substantially rigidly connected to, or formed integrally with, the respective engine pistons so that the driven members reciprocate rectilinearly in a cycle of movement. A crankshaft is mounted for rotation about an axis extending perpendicular to the engine cylinder axis. Means substantially directly connect each piston/device pair to a throw of the crankshaft. Thus, the crankshaft rotates once for each said cycle of movement thereby converting reciprocating movement into continuous rotating movement.

The connecting means and the crank shaft are of light construction since they do not transmit the full power developed by the engine pistons in operation of the engine. It is desired to retain the advantages of a free-piston engine while removing its prime disadvantages discussed above. This is mainly done in the present invention by synchronizing the pistons and defining their strokes at both ends of their reciprocating movement with as light a connecting means and rotatable crank shaft as is consistent with the operating characteristics under its expected design operating conditions of the engine in question.

In another aspect, the invention provides a power unit comprising an internal combustion engine which includes first and second opposed engine pistons arranged to reciprocate in opposition in a common engine cylinder, and first and second engine power utilization devices of substantially similar power absorbing characteristics to one another and each having a driven member substantially rigidly connected to, or formed integrally with, the respective engine pistons so that the driven members reciprocate rectilinearly in a cycle of movement, a crank shaft mounted for rotation about an axis extending perpendicular to and intersecting the longitudinal axis of the engine cylinder, and means connecting each piston/device pair to a throw of the crank shaft, whereby the crank shaft rotates once for each said cycle of movement.

In both aspects of the invention each connecting means preferably comprises a single connecting rod articulated at one end to a throw of the crank shaft and at the other end to a cross-head secured to the relevant piston/device pair and disposed between the piston and the device of that pair. It will be observed that a single connecting rod is the most direct means possible for inter-connecting a reciprocating member with a rotating crank shaft.

A flywheel is preferably rotatable with the crankshaft.

The engine power utilization devices may comprise compressor pistons moving in compressor cylinders each to supply a fluid such as air under pressure. The arrangement is preferably such that, at the end of the outward stroke the compressor cylinder clearance volumes have fluid therein to assist return of the engine pistons towards one another in their movement cycle.

The engine is preferably arranged to operate in a through scavenge two-stroke mode. The inward facing surfaces of the compressor pistons may be used to compress a working fluid for supporting combustion (e.g., a fuel/air mixture) to the desired scavenge pressure upon their inward strokes. When the compressed air is to be used for breathing, it is important to avoid any possibility of fuel/air mixture, or exhaust gases, contaminating the compressed air. In that case, a further piston and cylinder is disposed intermediate each engine and compressor piston pair and the further cylinder is suitably vented. A particular application of the invention is for supplying compressed air to charge pressure bottles to be carried by under-water divers as self-contained under water breathing apparatus (scuba divers).

The engine power utilization devices may alternatively comprise reciprocating electric power generators.

BRIEF DESCRIPTION OF THE DRAWINGS

Embodiments of the invention will now be described, by way of example, with reference to the accompanying drawings, in which;

Referring to FIGS. 1 and 2 there is shown an engine driven reciprocating air compressor comprising a pair of opposed engine pistons 10 arranged to reciprocate in opposition in an engine cylinder 11. Each piston 10 is rigidly connected by a piston rod 12 to a compressor piston 13 working in a compressor cylinder 14 coaxial with the engine cylinder 11. The piston rod 12 shown in composite but any other suitable piston rod could be used. The engine/compressor piston pairs are arranged for rectilinear reciprocation in opposition to one another between an inner-most position and the outermost position shown in FIG. 1.

Figure 1:
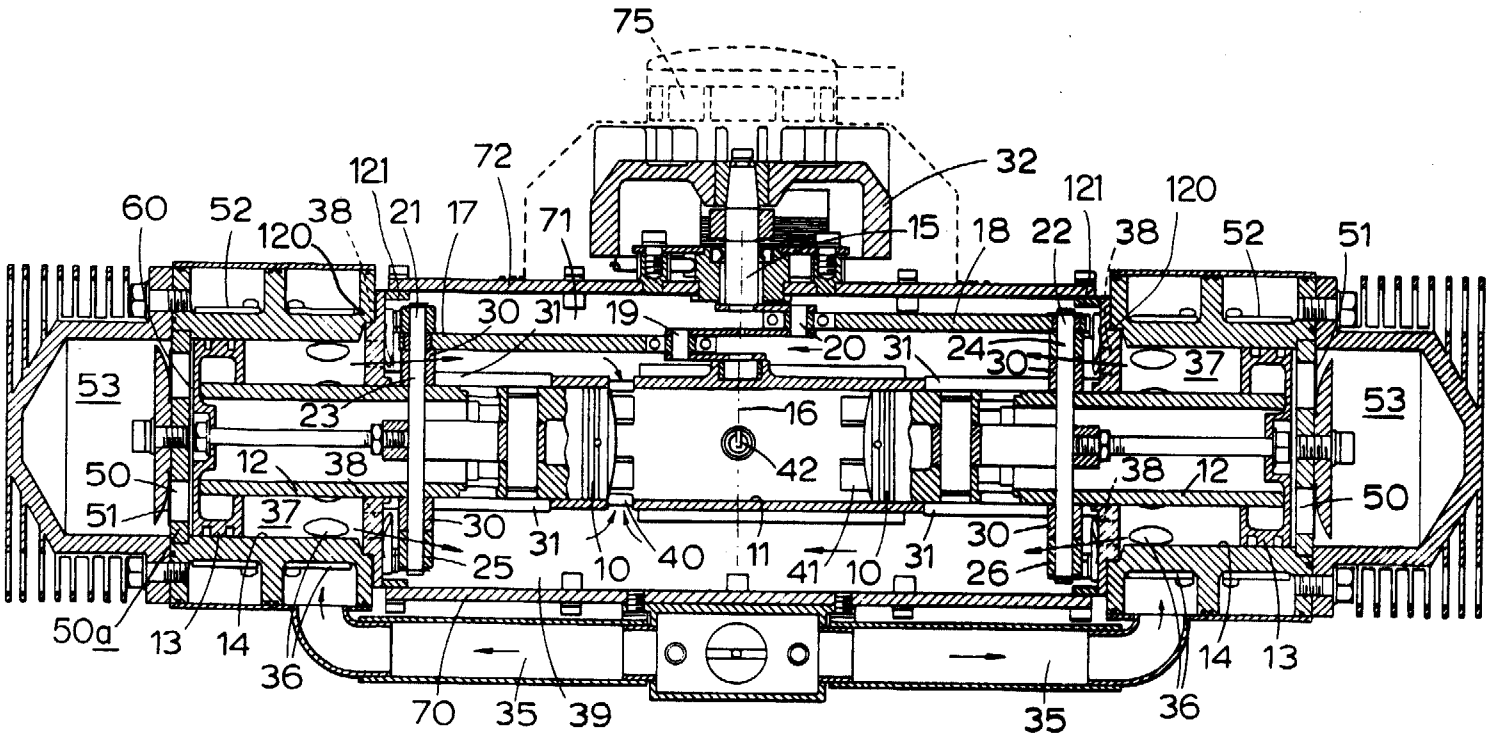
FIG. 1 is a longitudinal section on line X — X of FIG. 2, through an engine driven reciprocating air compressor according to the invention.

A crankshaft 15 is mounted for rotation as shown in FIG. 1 about an axis 16 extending perpendicular to and preferably intersecting the engine cylinder axis. A pair of light connecting rods 17, 18 are articulated at 19, 20 to opposite throws of the crankshaft 15, and their other ends are articulated at 21, 22 to cross-heads 23, 24 secured to the two piston rods 12. The cross-heads 23, 24 are provided with mass balances 25, 26 at the opposite side of the cylinder axis at least partly to compensate for the inertia of the connecting rods 17, 18.

The cross-heads 23, 24 are guided in their rectilinear reciprocation. For example, as shown, they are provided with circular cross-section bushes 30 that work in respective guide slots 31, provided with suitable opposed linear bearing surfaces, in the skirt of the power cylinder 11. The bushes 30 tend to roll along one bearing surface in one direction along the slot 31 and then return rolling in the same sense of rotation along the opposite bearing surface during a cycle of the pistons 10. The non-axial oscillating load thereby applied to the piston rods 12 is small due to the fact that the connecting rods 17, 18; and crankshaft 15 do not transmit the full power developed by the pistons 10. A flywheel 32 rotates with the crankshaft 15.

Figure 2:
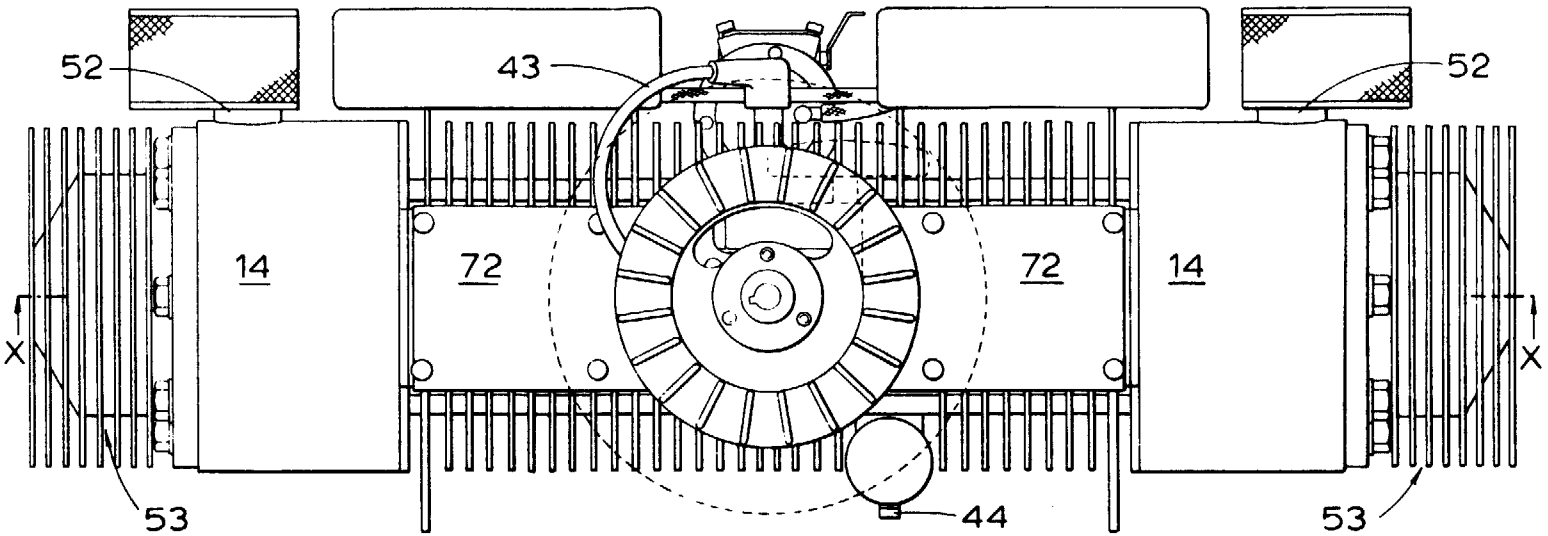
FIG. 2 is a side elevation thereof.

An inlet manifold 35 conducts a fuel/air mixture to the engine cylinder 11 via suction valve ports 36 into or chamber 37 serving as scavenge cylinders, then through valve ports 38 into spaces 39 and 71 and then through inlet/scavenge ports 40 into the engine cylinder 11. Space 39 extends along one side of the engine cylinder and is defined by a housing 70 and outer wall of the engine cylinder 11. Space 71 extends along the opposite side of the engine cylinder and is bounded by a housing 72 (FIG. 2). The crankshaft and connecting rods work within the space 71. As is evident in the drawings, spigot means 120 and 121 are effective to positively locate the axis of each chamber 37 so that each axis to aligned with the axis of cylinder 11.

Exhaust ports 41 are provided at the opposite end of the engine cylinder 11 to the inlet/scavenge ports 40, and communicate with an exhaust duct 44. A spark plug 42 is provided extending centrally into the engine cylinder, and is energized through a high tension lead 43, preferably from a magneto (not shown) driven by the crankshaft 15. The engine thus operates in a through scavenge two-stroke mode. The engine may employ direct or indirect fuel injection in place of carburetted fuel, or may be a Diesel engine. In the described embodiment oil in the charge assists lubrication of the bearing surfaces of the guide slots 31, and the crankshafts 15 and connecting rods 17, 18 within sapce 71.

The outer end of each compressor cylinder 13 has ports 50 in a cylinder head **50*a* with individual resilient steel reed valves 51. Air from compression enters the cylinder through nonreturn suction valves 52 and is compressed into receivers 53 for subsequent take-off and use as desired. The delivery valves 51 are arranged so that during a compression stroke of the compressor piston the reed is moved from its closed position shown in FIG. 1 to an open position which permits air to pass from the cylinder 14 through ports 50 into receiver 53. On the return stroke of the compressor piston the reeds return to their normally closed position as shown in FIG. 1**, and the suction valves open to admit a further charge.

The operation is as follows. On the inward stroke of the piston pairs 10, 13 from the FIG. 1 position, a fuel/air charge already present in the engine cylinder 11 is trapped therein as the inlet/scavenge ports 40 and exhaust ports 41 close, and is then compressed. At the same time the pistons 13, serving on their inward facing sides as positive displacement pump scavenge pistons deliver fuel/air mixture through the ports 38 into spaces 39 and 71 where it is held at a low pressure (the scavenge pressure). The pistons 13, serving as compressor pistons, on their inward induction strokes draw air into the compressor cylinders through ports 52. The pistons 13 may be regarded as compressor and scavenge pistons on their opposite sides. The necessary driving energy for this inward stroke comes jointly from the stored rotational energy in the flywheel 32 and the re-expansion of the air left in the compressor cylinder clearance volumes shown at 60 at the end of previous outward compression stroke.

The spark plug 42 fires the charge and the pistons commence an outward power stroke. The compressor pistons 13 therefore compress air and force it to flow past valves 51 into the receivers 53. At the same time, the pistons 13 serving as scavenge pistons are on their induction stroke drawing fuel/air mixture through ports 36 into scavenge cylinders 37. When the ports 40 and 41 open, the exhaust gases escape through ports 41 while fuel/air mixture, which has been held in spaces 39 and 71, enters cylinder 11 through scavenge ports 40 driving out the remaining exhaust gases and charging the engine cylinder for the next inward stroke. Outward acceleration of the piston pairs also restores rotational energy to the flywheel for the next cycle.

It will be seen that the power developed by the engine is transmitted directly from the engine pistons 10 to the compressor pistons 13. This means that the connecting rods 17, 18 and crankshaft 15 can be considerably lighter than they would have to be if they carried the full power developed by the engine pistons 10. They serve to synchronize the movement of the two piston pairs 10, 13, to assist in returning the piston pairs 10, 13 towards their inner-most position, to provide rotary motion for driving cooling means such as a fan, and fuel and oil pumps, and to provide a convenient means for starting the engine. A rope or chain pull start mechanism 75 is schematically shown, as an example, in FIG. 1. None of these functions of course require transmission of the full power of the engine pistons 10.

It will also be seen that the engine and its operation is substantially symmetrical about a central vertical axis through FIG. 1, apart from the through flow scavenging. This provides dynamic balance.

The mass and strength of the connecting rods 17, 18 and crankshaft 15 is related to the mass and inertia of the flywheel 32. One design approach is to start with a figure for the tolerable cyclic flywheel speed variation. This will depend partly on the application. Cyclic speed variation is relatively unimportant in an air compressor, but may be of considerable importance where the engine power drives the driven member, e.g., armature, of a reciprocating electric power generator. This figure gives the tolerable energy variation per cycle of the flywheel 32. Calculations on the operation of the chosen arrangement of the piston pairs 10, 13 and engine capacity, and compressor clearance volume 60 can yield an energy requirement that the flywheel 32 must supply to the piston pairs 10, 13 through the crankshaft 15 and connecting rods during each half cycle, and the same quantum of energy is restored to the flywheel 32 in the next half cycle. Placing this energy need together with the tolerable energy variation yields the necessary minimum inertia and therefore mass and radius of the flywheel 32, and this in turn gives the minimum mass and strength of the crankshaft 15 and connecting rods 17, 18. Certain allowances need to be made for the auxiliary devices such as the fan and magneto driven by the flywheel 20.

In a particular embodiment an engine driven air compressor according to the invention was designed to run at about 3,000 operating cycles per minute (the crankshaft thus rotates at 3,000 r.p.m.). The compressor was designed to deliver about 570 liters per minute of air at about 7 Bars (700,000 pascals) at both ends.

A practical embodiment has an engine cylinder bore of 43 mms., a compressor cylinder bore of 76 mms., and a stroke of each piston pair of 44 mms. The overall weight of the engine/compressor power unit in running condition including lubricating oil and fuel supply is under 20 Kgs., and fits within the outside dimensions of: 260 × 280 × 560 mms. It is thus readily portable.

Clearly a two or more stage compressor could be used in which the pressurized air from a first stage is delivered to a second stage for further compression. In other embodiments the compressed air from one end of cylinder 14 can be delivered to the other end of cylinder 14 for further compression.

In yet other embodiments the engine power may be utilized to drive the armature of a reciprocating electric power generator at each end of the power unit. The return energy that came from clearance 60 is, in this case, instead provided by other means such as a closed cushion cylinder. U.K. Pat. No. 1,251,562 shows a reciprocating generator.

Figure 3:
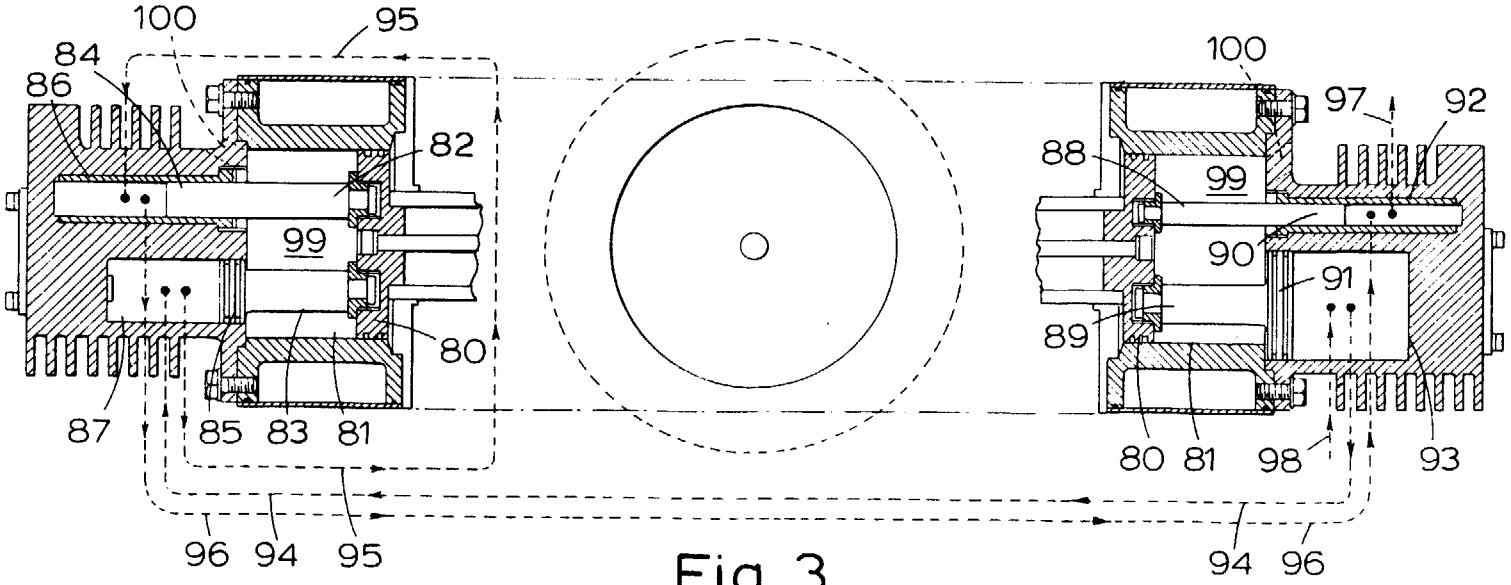
FIG. 3 is a longitudinal section, partly schematic, of a four-stage compressor according to the invention.

Referring now to FIG. 3 there is shown a four-stage embodiment of the engine driven air compressor. In FIG. 3 the engine portion of the power unit is the same as described above and shown in FIGS. 1 and 2 and is thus neither shown nor described further.

FIG. 3 shows a pair of pistons 80 working in cylinders 81. Pistons 80 are rigidly connected to piston rods 12 and serve on their inner facing surfaces as scavenge pistons in an identical manner to the inner facing surfaces of pistons 13 described above.

Connected to the left-hand piston 80 are two parallel piston rods 82, 83 in turn connected to or formed integrally with two pistons 84, 85 that work in respective cylinders 86, 87. Connected to the righthand piston 80 are two further parallel piston rods 88, 89 in turn connected to or formed integrally with two pistons 90, 91 that work in respective cylinders 92, 93. The four cylinders 86, 87, 92, 93 are the four stages of an air compressor. Air compressed in the first-stage cylinder 93 is conducted by pressure line (indicated schematically at 94) to the second-stage cylinder 87. Similarly air compressed in cylinder 87 is conducted by line 95 to the third-stage cylinder 86; air compressed in cylinder 86 is conducted by line 96 to the fourth stage cylinder 92, and air compessed in cylinder 92 is taken off by line 97 to a receiver or utilization point. Each compressor cylinder is provided with appropriate valving in relation to the stroke of its associated piston so that air compressed in that cylinder on the outward stroke is caused to flow into the pressure line to the next higher stage, and so that on the inward stroke air is drawn into that cylinder from the pressure line from the next lower stage. The first stage is provided with inlet valving (shown schematically at 98).

The first and fourth stages at the righthand end substantially balance the second and third stages at the left-hand end, the piston diameters being chosen so that substantially similar load absorbing characteristics are presented to the two opposed engine pistons. Similarly the extent by which the lines of action of the four pistons are laterally off-set from the engine longitudinal axis are chosen so that the lateral moments exerted are balanced as between the first and fourth stage pistons and as between the second and third stage pistons. The relative volumes of the pressure lines 94, 95 and 96 are also chosen to be matched to the appropriate requirements of the associated stages. Line 95 adopts a circuitous route for cooling purposes.

In the FIGS. 1 and 2 embodiment, leakage of fuel/air mixture could take place across the piston rings of piston 13 from the scavenge side to the air compression side. The leakage would be small because the pressure is generally higher on the air compression side. However, any leakage would be unacceptable where the compressed air is to be used for breathing, e.g., for charging air bottles for scuba divers and other. In the FIG. 3 embodiment the space 99 within cylinders 81 on the outer face of piston 80 serves to isolate the fuel/air mixture compressed by the inner faces of pistons 80 from the air compressed by the outer faces of pistons 84, 85, 90 and 91. Each space 99 is vented to atmosphere by ports 100. Any leakage from the air compressor cylinders would tend to be into the spaces 99. Any leakage of fuel/air mixture across pistons 80 into spaces 99 on an inward stroke would be positively pumped out through ports 100 on the next outward stroke. Cylinders 81 never have more than low pressure fluid therein and thus lubrication of piston 80 can be minimal.

In embodiments wherein the engine employs certain forms of fuel injection, or is a Diesel engine, the inner faces of pistons 13 or 80 may be employed to raise the induction air to the scavenge pressure.

In a modification of FIG. 3 the two stages at each end of the unit may be arranged in line as a stepped piston arrangement, instead of the laterally spaced arrangement of FIG. 3.

I claim:

1. A hand-portable power unit comprising:

(a) an internal combustion engine, and (b) first and second engine power utilization devices, (c) said engine including a common engine cylinder and first and second opposed engine pistons arranged to reciprocate in opposition in said common engine cylinder, (d) said first and second engine power utilization devices being of substantially similar power absorbing characteristics to one another and each having a driven member, (e) first connecting means substantially rigidly connecting each said driven member to a respective one of said first and second opposed engine pistons so that said driven members reciprocate rectilinearly in a cycle of movement, (f) a crankshaft having first and second throws, (g) means mounting said crankshaft for rotation about an axis extending perpendicular to the engine cylinder axis, and (h) second connecting means substantially directly connecting each piston/device pair to a respective said throw of said crankshaft, whereby said crankshaft rotates once for each said cycle of movement to convert reciprocating motion into continuous rotating motion, (i) said second connecting means being effective to synchronize the movement of each said piston/device pair with respect to each other and the rotating crankshaft, (j) said second connecting means being further effective to transmit less than the full power developed by said engine to rotate said crankshaft.

2. A power unit useable in hand-portable equipment comprising:

(a) an internal combustion engine, and (b) first and second engine power utilization devices, (c) said engine including a common engine cylinder and first and second opposed engine pistons arranged to reciprocate in opposition in said common engine cylinder, (d) said first and second engine power utilization devices being of substantially similar power absorbing characteristics to one another and each having a driven member, (e) first connecting means substantially rigidly connecting each said driven member to a respective one of said first and second opposed engine pistons so that said driven members reciprocate rectilinearly in a cycle of movement, (f) a single crankshaft having first and second throws and being disposed to one side of said engine cylinder, (g) means mounting said crankshaft for rotation about an axis extending perpendicular to and intersecting the longitudinal axis of the engine cylinder, and (h) second connecting means substantially directly connecting each piston/device pair to a respective said throw of said crankshaft, whereby said crankshaft rotates once for each said cycle of movement to convert reciprocating motion into continuous rotating motion.

3. A power unit according to claim 2, including a cross-head, means securing said cross-head to the relevant piston/device pair, and means constraining the cross-head to follow a substantially rectilinear path, said cross-head being disposed between the piston and the device of that relevant pair and wherein each said second connecting means comprises a single connecting rod, means articulating said connecting rod at one end to a respective said throw of the crankshaft, and means articulating said connecting rod at the other end to a respective said cross-head.

4. A power unit according to claim 3 wherein said crankshaft axis intersects the longitudinal axis of the engine cylinder at a point midway between said two opposed engine pistons, said piston/device pairs have equal strokes, and said connecting rods are of equal length and lie and work in planes which are parallel to one another and to a plane including the engine longitudinal axis.

5. A power unit according to claim 3 including mass balances associated with each said cross-head at the end thereof opposite the end to which the relevant connecting rod is articulated, whereby partly to compensate for inertia effects of the connecting rod on the piston/device pair.

6. A power unit according to claim 1 including an engine casing and wherein said common engine cylinder has an outer wall, said casing being spaced from said outer wall to define a substantially enclosed space, wherein means is provided for introducing to said space a fuel/air mixture in response to movement of the piston/device pairs toward one another during a compression stroke of the engine and wherein an inlet port is formed through said engine cylinder wall so that fuel/air mixture can flow into said common engine cylinder from said space when said piston/device pairs have moved apart by a predetermined extent during an expansion stroke of the engine, and wherein said second connecting means and said crankshaft work within said space.

7. A power unit according to claim 1 wherein said engine is adapted to operate in a through scavenge two-stroke mode.

8. A power unit according to claim 1 wherein at least one of said utilization devices comprises a compressor cylinder and a compressor piston movable in said compressor cylinder and operable to supply a fluid under pressure.

9. A power unit according to claim 8 wherein the compressor cylinder is arranged to leave a clearance volume at the end of an outward stroke of said compressor piston, the subsequent re-expansion of the fluid retained under pressure in said clearance volume thereby assisting return of the engine pistons toward one another in said cycle.

10. A power unit according to claim 8 including a further cylinder and a further piston movable in said further cylinder, said further piston being disposed between a said engine piston and a said compressor piston, and means for venting said further cylinder at the side of the further piston remote from the engine cylinder.

11. A power unit according to claim 10 including a suction valve port formed through the wall of said further cylinder so that working fluid for supporting combustion is drawn into said further cylinder at the side of the further piston remote from the fluid being compressed as the piston/device pairs move apart beyond a predetermined spacing and means for supplying to the engine cylinder the working fluid compressed by inward movement of said further pistons.

12. A power unit according to claim 3 in which said cross-head constraining means includes a bush which reciprocates in a guide slot formed in said common engine cylinder.

13. A power unit useable in hand-portable equipment comprising:

(a) an internal combustion engine, (b) first and second engine power utilization devices, (c) said engine including a common engine cylinder and first and second opposed engine pistons arranged to reciprocate in opposition in said common engine cylinder, (d) said first and second engine power utilization devices being of substantially equal power absorbing characteristics to one another and each having a driven member, (e) first connecting means substantially rigidly connecting each said driven member to a respective one of said first and second opposed engine pistons so that said driven members reciprocate rectilinearly in a cycle of movement, (f) a crankshaft having first and second throws, (g) means mounting said crankshaft for rotation about an axis extending perpendicular to and intersecting the longitudinal axis of the engine cylinder, and (h) second connecting means including a single connecting rod substantially directly connecting each piston/device pair to a respective said throw of said crankshaft, whereby said crankshaft rotates once for each said cycle of movement.

14. A power unit useable in hand-portable equipment comprising:

(a) an internal combustion engine, (b) first and second engine power utilization devices, (c) said engine including a common engine cylinder and first and second opposed engine pistons arranged to reciprocate in opposition in said common engine cylinder, (d) said first and second engine power utilization devices being of substantially equal power absorbing characteristics to one another and each having a driven member, (e) first connecting means substantially rigidly connecting each said driven member to a respective one of said first and second opposed engine pistons so that said driven members reciprocate rectilinearly in a cycle of movement, (f) a crosshead extending transversely from each of said first connecting means, (g) means constraining each crosshead to follow a substantially rectilinear path, (h) a crankshaft having first and second throws, (i) means mounting said crankshaft for rotation about an axis extending perpendicular to and intersecting the longitudinal axis of the engine cylinder, and (j) a single connecting rod articulated at one end to said first throw of the crankshaft and at its other end to one of said crossheads, (k) a further single connecting rod articulated at one end to said second throw of said crankshaft and at its other end to the other of said crossheads, (l) each rod being connected to the respective crosshead on the same side of the engine cylinder axis, (m) the crossheads being further provided with mass balance at the opposite side of the cylinder axis to at least partly compensate for the inertia of the connecting rods.

15. A power unit useable in hand-portable equipment comprising:

(a) an internal combustion engine, (b) first and second engine power utilization devices, (c) said engine including a common engine cylinder and first and second opposed engine pistons arranged to reciprocate in opposition in said common engine cylinder, (d) said first and second engine power utilization devices being of substantially equal power absorbing characteristics to one another and each having a driven member, (e) first connecting means substantially rigidly connecting each said driven member to a respective one of said first and second opposed engine pistons so that said driven members reciprocate rectilinearly in a cycle of movement, (f) a crosshead extending transversely from each of said first connecting means, (g) each said crosshead carrying a rotatable bush which reciprocates in a guide slot formed in said common engine cylinder and extending parallel to said longitudinal axis of the engine cylinder on one side thereof, (h) a crankshaft having first and second throws, (i) means mounting said crankshaft for rotation about an axis extending perpendicular to and intersecting the longitudinal axis of the engine cylinder, (j) a single connecting rod articulated at one end to said throw of the crankshaft and at its other end to one of said crossheads, (k) a further single connecting rod articulated at one end to said second throw of said crankshaft and at its other end to the other of said crossheads, (l) each said connecting rod being articulated to its respective crosshead on the same side of said cylinder axis as said guide slot, and (m) the portion of each said crosshead extending on the opposite side of said cylinder axis being provided with a mass balance to at least partly compensate for the inertia of the connecting rods.

16. A power unit useable in hand-portable equipment comprising:

(a) an internal combustion engine, (b) first and second power utilization devices, (c) said engine including an engine casing and a common engine cylinder having an outer wall, said casing being spaced from said outer wall to define a substantially enclosed space, (d) said first and second engine power utilization devices being of substantially equal power absorbing characteristics to one another and each having a driven member movable in a chamber, (e) first connecting means substantially rigidly connecting each said driven member to a respective one of said first and second opposed engine pistons so that said driven members reciprocate rectilinearly within respective said chambers in a cycle of movement, (f) porting means interconnecting said chambers with engine cylinder such that a fuel/air mixture drawn into said chambers during an expansion stroke of the engine is transferred into said space through said porting means in response to movement of the piston/device pairs toward one another during a compression stroke of the engine, (g) an inlet port formed through said engine cylinder wall so that said fuel/air mixture can flow into said common engine cylinder from said space when said piston/device pairs have moved apart by a predetermined extent during an expansion stroke of the engine, (h) a crankshaft having first and second throws, (i) means mounting said crankshaft for rotation within said space about an axis extending perpendicular to and intersecting the longitudinal axis of the engine cylinder, and (j) a single connecting rod articulated at one end to said first throw of the crankshaft and at its other end to one of said first connecting means, (k) a further single connecting rod articulated at one end to said second throw of said crankshaft and at its other end to the other of said first connecting means, (l) said connecting rods working within said space between the engine cylinder wall and the engine casing.

17. A power unit useable in hand-portable equipment comprising:

(a) an internal combustion engine, (b) first and second power utilization devices, (c) said engine including an engine casing and a common engine cylinder having an outer wall to define a substantially enclosed space, (d) said first and second engine power utilization devices being of substantially equal power absorbing characteristics to one another and each having a driven member movable in a chamber, (e) first connecting means substantially rigidly connecting each said driven member to a respective one of said first and second opposed engine pistons so that said driven members reciprocate rectilinearly within respective said chambers in a cycle of movement, (f) means interconnecting each of said chambers with said casing, said interconnecting means including spigot means for positively locating the axis of each said chamber, such that each said axis is aligned with the axis of said engine cylinder, (g) a crankshaft having first and second throws, (h) means mounting said crankshaft for rotation within said space about an axis extending perpendicular to and intersecting the longitudinal axis of the engine cylinder, (i) second connecting means substantially directly connecting each piston/device pair to a respective said throw of said crankshaft whereby said crankshaft rotates once for each said cycle of movement.

18. A power unit comprising:

(a) an internal combustion engine, and (b) first and second engine power utilization devices, (c) said engine including a common engine cylinder and first and second opposed engine pistons arranged to reciprocate in opposition in said common engine cylinder, (d) said first and second engine power utilization devices being of substantially similar power absorbing characteristics to one another and each having a driven member, (e) at least one of said utilization devices comprising a compressor cylinder and a compressor piston movable in said compressor cylinder and operable to supply a fluid under pressure, (f) said first utilization device comprising two said compressor pistons respectively movable in respective said compressor cylinders and serving as the first and fourth stages of a four-stage fluid compressor, (g) said second utilization device comprising two further said compressor pistons respectively movable in respective said compressor cylinders and serving as the second and third stages of said fluid compressor (h) means fluidly interconnecting said compressor stages, (i) first connecting means substantially rigidly connecting each said driven member to a respective one of said first and second opposed engine pistons so that said driven members reciprocate rectilinearly in a cycle of movement, (j) a crankshaft having first and second throws, (k) means mounting said crankshaft for rotation about an axis extending perpendicular to the engine cylinder axis, and (l) second connecting means substantially directly connecting each piston/device pair to a respective said throw of said crankshaft, whereby said crankshaft rotates once for each said cycle of movement to convert reciprocating motion into continuous rotating motion.

19. A power unit according to claim 18 wherein the two pairs of compressor cylinders at each end of the engine are each spaced laterally from one another with respect to the longitudinal axis of the engine cylinder.

* * * * *